US006467536B1

(12) United States Patent
Abate et al.

(10) Patent No.: US 6,467,536 B1
(45) Date of Patent: Oct. 22, 2002

(54) EVAPORATOR AND METHOD OF MAKING SAME

(75) Inventors: Gugliemo (William) Abate, Dearborn; John Joseph Meyer, Northville, both of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/470,402

(22) Filed: Dec. 29, 1999

(51) Int. Cl.[7] ..... F28D 1/02; F28F 9/02
(52) U.S. Cl. ..... 165/153; 165/173; 165/151
(58) Field of Search ..... 165/153, 167, 165/173, 151

(56) References Cited

U.S. PATENT DOCUMENTS 4,234,041 A 11/1980 Melnyk
4,846,268 A * 7/1989 Beldam et al. ..... 165/153
4,969,512 A * 11/1990 Aoki et al. ..... 165/153
5,036,909 A 8/1991 Whitehead et al.
5,046,555 A 9/1991 Nguyen
5,178,211 A * 1/1993 Bauer et al. ..... 165/153
5,327,959 A * 7/1994 Saperstein et al. ..... 165/153
5,348,081 A * 9/1994 Halstead et al. ..... 165/153
5,634,519 A * 6/1997 Laveran ..... 165/153
5,901,782 A 5/1999 Voss et al.
5,918,664 A * 7/1999 Torigoe ..... 165/76
5,937,935 A * 8/1999 Schornhorst et al. ..... 165/76

* cited by examiner

*Primary Examiner*—Henry Bennett
*Assistant Examiner*—Tho V Duong
(74) *Attorney, Agent, or Firm*—Larry I. Shelton

(57) ABSTRACT

An evaporator and method of making same includes a first end tank, a second end tank spaced from and opposing the first end tank, and a plurality of extruded fluid carrying tubes extending between and in fluid communication with the first end tank and the second end tank. The first end tank and the second end tank are formed as stampings.

8 Claims, 1 Drawing Sheet

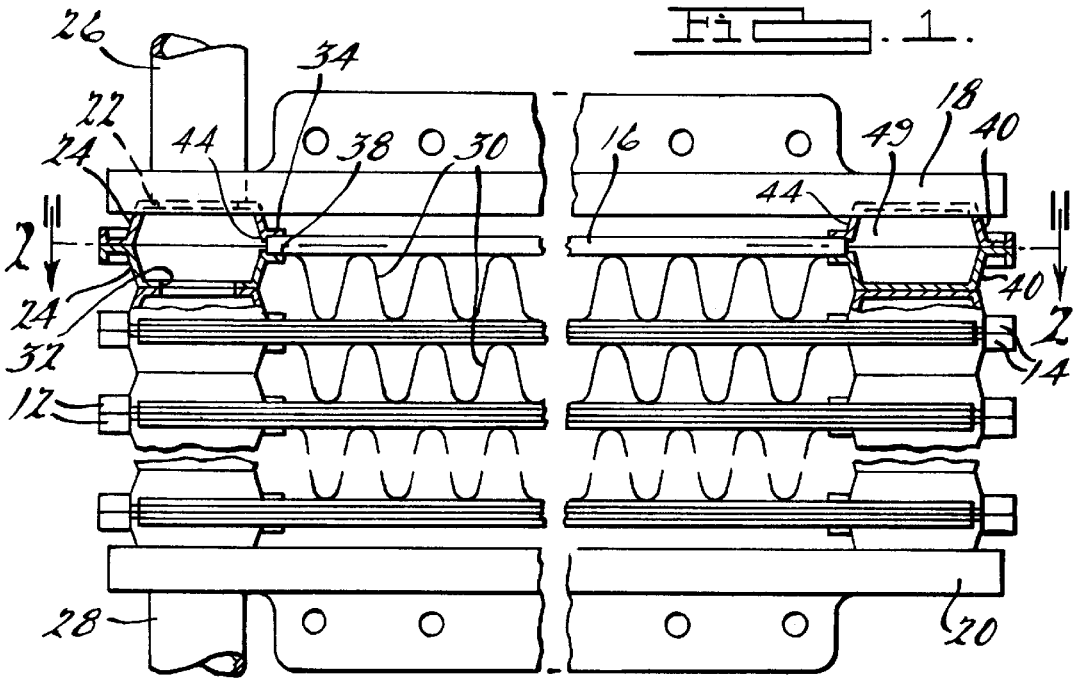
Fig. 1.
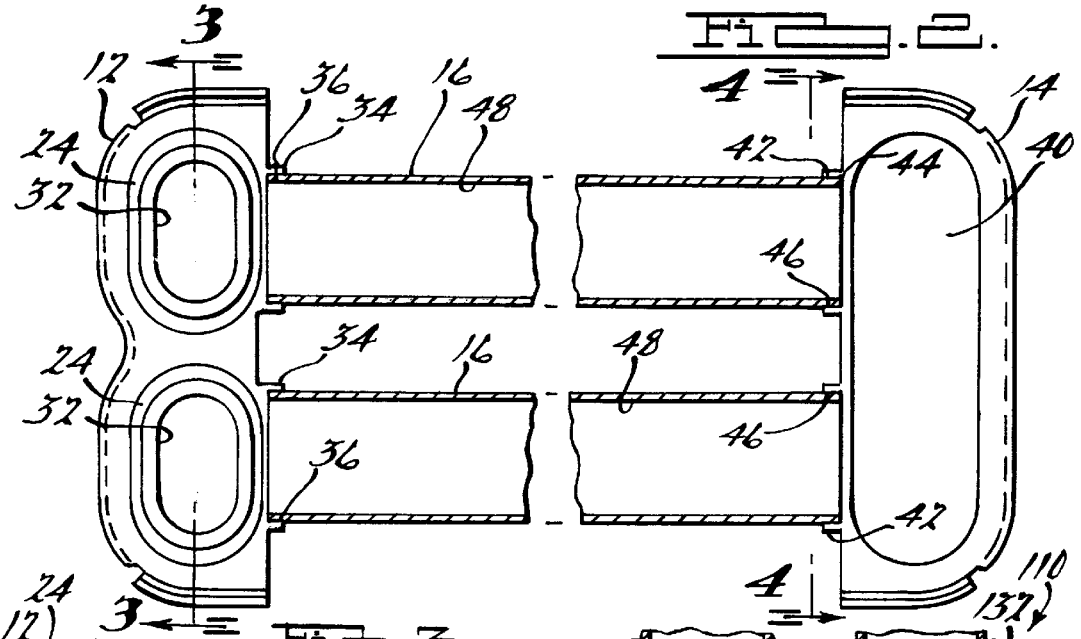
Fig. 2.
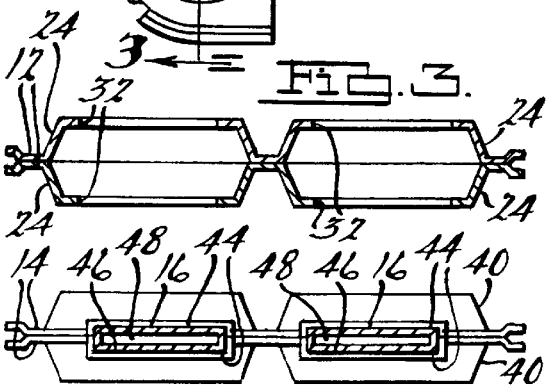
Fig. 3.
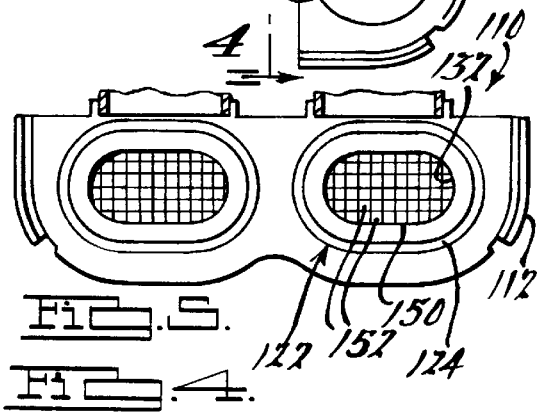
Fig. 5.
Fig. 4.

EVAPORATOR AND METHOD OF MAKING SAME

BACKGROUND OF THE INVENTION

1. Field of the Invention

The present invention relates generally to heat exchangers and, more specifically, to an evaporator and method of making same with stamped end tanks and extruded tubes for an air conditioning system in a motor vehicle.

2. Description of the Related Art

It is known to provide a heat exchanger such as an evaporator for an air conditioning system in a motor vehicle. The evaporator typically receives a fluid such as a refrigerant. The evaporator normally includes a plurality of flow passages, which may, for example, be constructed from flat plates or extruded, tubes extending between opposite manifolds or end tanks. The evaporator also includes a plurality of cooling fins disposed between the flow passages. Evaporators are generally much thicker than condensers, and thus require as manifolds or end tanks that may be as wide or wider than fifty-five millimeters. One type of evaporator, often referred to as an extruded tube evaporator, includes a plurality of extruded tubes extending between the end tanks to direct the refrigerant through a plurality of flow paths. However, the end tanks typically used for extruded tube condensers do not have the required strength due to the vastly increased surface area and thus force present in such a wide heat exchanger. Another type of evaporator, often referred to as a plate-fin evaporator, includes a plurality of plates extending between the end tanks to direct the refrigerant through a plurality of flow paths. The end tanks are stamped by using a drawn-cup process.

Therefore, it is desirable to provide an evaporator with stamped end tanks and extruded tubes. It is also desirable to combine the benefits of stamped plate-fin evaporators and extruded tube heat exchangers.

SUMMARY OF THE INVENTION

Accordingly, the present invention is an evaporator including a first end tank, a second end tank spaced from and opposing the first end tank, and a plurality of extruded fluid carrying tubes extending between and in fluid communication with the first end tank and the second end tank. The first end tank and the second end tank are formed as stampings.

One advantage of the present invention is that a new evaporator and method of making same are provided for an air conditioning system of a motor vehicle. Another advantage of the present invention is that the evaporator has extruded tubes and stamped end tanks. Yet another advantage of the present invention is that the evaporator combines the benefits of stamped plate-fin evaporators and extruded tube heat exchangers. Still another advantage of the present invention is that the evaporator uses a drawn-cup manifold, stamped such that, when assembled, accept extruded tubes for passage of refrigerant. A further advantage of the present invention is that the evaporator has the increased heat transfer surface area of the extruded tube combined with the strength and manufacturing flexibility of a drawn-cup manifold.

Other features and advantages of the present invention will be readily appreciated, as the same becomes better understood, after reading the subsequent description taken in conjunction with the accompanying drawings.

BRIEF DESCRIPTION OF THE DRAWINGS

FIG. 1 is a fragmentary elevational view of an evaporator, according to the present invention.

FIG. 2 is a sectional view taken along line 2—2 of FIG. 1.

FIG. 3 is a sectional view taken along line 3—3 of FIG. 2.

FIG. 4 is a sectional view taken along line 4—4 of FIG. 2.

FIG. 5 is a plan view of another embodiment, according to the present invention, of the evaporator of FIG. 1.

DESCRIPTION OF THE PREFERRED EMBODIMENT(S)

Referring to the drawings and in particular FIG. 1, one embodiment of a heat exchanger such as an evaporator 10, according to the present invention, is shown for an air conditioning system (not shown) in a motor vehicle (not shown). The evaporator 10 includes a pair of generally parallel manifolds or end tanks, first end tank 12 and second end tank 14 spaced apart a predetermined distance, pairs of which are joined together in a face-to-face relationship to form a stack. The evaporator 10 also includes a plurality of generally parallel, flat tubes 16 extending between the end tanks 12,14 and conducting fluid such as a refrigerant between them. The evaporator 10 includes oppositely disposed first and second mounting plates 18 and 20 at ends of the stack. The evaporator 10 further includes a fluid inlet 26 for directing fluid into the evaporator 10 formed in the first mounting plate 18 and a fluid outlet 28 for directing fluid out of the evaporator 10 formed in the second mounting plate 20. The fluid inlet 26 and fluid outlet 28 fluidly communicate with flow headers, generally indicated at 22, formed by bosses 24 on each of the end tanks 12,14. The evaporator 10 also includes a plurality of convoluted or serpentine fins 30 disposed between the tubes 16 and attached to an exterior of each of the tubes 16. The fins 30 serve as a means for conducting heat away from the tubes 16 while providing additional surface area for convective heat transfer by air flowing over the evaporator 10. It should be appreciated that the evaporator 10 could be used as a heat exchanger in other applications besides motor vehicles.

Referring to FIGS. 2 through 4, the first and second end tanks 12,14 extend laterally and are substantially planar or flat. The first end tank 12 includes at least one, preferably a pair of raised bosses 24 spaced laterally. The bosses 24 extend laterally and vertically. Each boss 24 has an aperture 32 extending therethrough. Each boss 24 also includes a flange 34 extending axially and having a generally U-shaped cross-section to receive an end of the tube 16. The flange 34 may include a projection 36 such as a dimple extending outwardly and laterally to act as a positive stop for locating the tube 16. The bosses 24 are stacked together such that the apertures 32 are aligned to form the flow headers 22 to allow parallel flow of fluid such as refrigerant through the tubes 16. The flanges 34 are also stacked together to form a slot or opening 38 to receive one end of the tubes 16. The first end tank 12 is made of a metal material such as aluminum having a cladding on its inner and outer surfaces for brazing. The first end tank 12 is also formed as a stamping using a drawn-cup stamping process which is conventional and known in the art.

The second end tank 14 may include at least one raised boss 40 extending laterally and vertically. The boss 40 acts as a solid plate baffle. The second end tank 14 includes at least one, preferably a pair of flanges 42 spaced laterally and extending axially. Each of the flanges 42 has a generally U-shaped cross-section to receive the other end of the tubes 16. Each flange 42 may include a projection 44 such as a dimple extending outwardly and laterally to act as a positive stop for locating the tube 16. The bosses 40 are stacked together to allow flow of fluid such as refrigerant between the laterally spaced tubes 16. The flanges 42 are also stacked together to form a slot or opening 46 to receive the other end of the tubes 16. The second end tank 14 is made of a metal material such as aluminum having a cladding on its inner and outer surfaces for brazing. The second end tank 14 is also formed as a stamping using a drawn-cup stamping process which is conventional and known in the art.

The tubes 16 extend axially and are generally rectangular in cross-sectional shape. Each of the tubes 16 has a passageway 48 extending axially therethrough to allow a fluid such as refrigerant to pass therethrough. The tubes 16 are made of a metal material such as aluminum having a cladding on its inner and outer surfaces for brazing. The tubes 16 are formed as an extrusion using an extrusion process, which is conventional and known in the art.

In operation, fluid such as refrigerant from the air conditioning system enters the evaporator 10 through the fluid inlet 26 on the first mounting plate 18. The refrigerant flows in the flow header 22 of a first pair of joined first end tanks 12 and flows through the passageway 48 in one of the tubes 16. The refrigerant flows from the tube 16 and through a channel 49 of the first pair of joined second end tanks 14 and through the passageway 48 of the other laterally spaced tube 16. The refrigerant flows from the tube 16 and out of the other flow header 22 in the first pair of joined end tanks 12. The refrigerant flow repeats this U-shaped flow through each level of the evaporator 10 and exits the evaporator 10 through the fluid outlet 28 on the second mounting plate 20. It should be appreciated that refrigerant flows though several tubes in parallel, with baffles (not shown) directing the flow. It should also be appreciated that there are may different options for circuiting refrigerant such that it goes through one face of the core first, up the other face or u-flows down the core and that baffles (not shown) may be located between joined pairs of end tanks 12,14 to direct the refrigerant flow as desired.

Also, a method of making the evaporator 10, according to the present invention, is shown. The method includes the step of contacting a pair of first end tanks 12 with each other to form the flow headers 22 and contacting opposed flanges 34 with each other to form the openings 38. The method includes the step of brazing the pair of first end tanks 12 by heating the first end tanks 12 to a predetermined temperature to melt the brazing material to braze the first end tanks 12 together. The pair of joined first end tanks 12 is then cooled to solidify the molten braze material to secure the first end tanks 12 together. The method includes the step of contacting a pair of second end tanks 14 with each other to form the channel 49 therebetween and contacting opposed flanges 42 with each other to form the openings 46. The method includes the step of brazing the pair of second end tanks 14 by heating the second end tanks 14 to a predetermined temperature to melt the brazing material to braze the second end tanks 14 together. The pair of joined second end tanks 14 is then cooled to solidify the molten braze material to secure the second end tanks 14 together. The method includes the step of inserting one end of the tube 16 in one of the openings 38 of the first end tank 12 until the tube 16 contacts the projection 36. The method includes the step of inserting the other end of the tube 16 in one of the openings 46 of the second end tank 14 until the tube 16 contacts the projection 44. The method includes the step of inserting one end of another tube 16 in the other of the openings 38 of the first end tank 12 until the tube 16 contacts the projection 36. The method includes the step of inserting the other end of the tube 16 in the other of the openings 46 of the second end tank 14 until the tube 16 contacts the projection 44. The method includes the step of stacking the joined end tanks 12, 14 together and aligned in a stack. The method includes the step of disposing fins 30 between the tubes 16 and joining, such as by brazing, the fins 30, tubes 16 and the stack of the joined end tanks 12,14 together. The brazing is accomplished by heating the end tanks 12,14, tubes 16 and fins 30 to a predetermined temperature to melt the brazing material to braze the bosses 24,40 together. The stack of joined end tanks 12,14 is then cooled to solidify the molten braze material to secure the bosses 24,40 and the tubes 16 and fins 30 together. The method includes the step of connecting the first and second mounting plates 18 and 20 to the brazed end tanks 12,14 to form the evaporator 10. It should be appreciated that the end tanks 12,14 could be stacked and the tubes 16 and fins 30 assembled to the end tanks 12,14 and brazing the assembly together at one time to form the evaporator.

Referring to FIG. 5, another embodiment 110, according to the present invention, is shown for the evaporator 10. Like parts of the evaporator 10 have like reference numerals increased by one hundred (100). In this embodiment, the evaporator 110 may include a screen or mesh 150 stamped into the first end tank 112 in the apertures 132 for improved flow distribution through the flow headers 122. The mesh 150 is a generally rectangular grid forming a plurality of apertures 152 having a generally rectangular shape to allow fluid to pass therethrough. The mesh 150 and apertures 152 may have any suitable shape. The evaporator 110 is made and operates similar to the evaporator 10. It should be appreciated that the mesh 150 could be stamped into either one or both end tanks 112,114.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An evaporator comprising:

a pair of joined first end tanks;

a pair of joined second end tanks spaced from and opposing said first end tanks;

a plurality of extruded fluid carrying tubes extending between and in fluid communication with said first end tanks and said second end tanks; and each of said first end tanks and said second end tanks comprising a stamping, each of said first end tanks having a pair of raised first bosses spaced laterally and extending outwardly therefrom and each of said first bosses including a first flange extending axially to form a first opening to receive an end of one of said tubes, wherein a pair of said tubes are spaced laterally and joined to said first end tanks.

2. An evaporator as set forth in claim 1 wherein said first flange has a first projection extending outwardly into said first opening to act as a stop to locate the one end of said tubes relative to said first opening.

3. An evaporator as set forth in claim 1 wherein each of said first bosses includes an aperture extending therethrough.

4. An evaporator as set forth in claim 1 wherein each of said second end tanks includes at least one raised second boss extending laterally and outwardly therefrom.

5. An evaporator as set forth in claim 4 wherein each of said second end tanks includes a pair of second flanges spaced laterally and extending axially, each of said second flanges forming a second opening to receive one end of said tubes.

6. An evaporator as set forth in claim 5 wherein each of said second flanges has a second projection extending outwardly into said second opening to act as a stop to locate the one end of said tubes relative to said second opening.

7. An evaporator comprising:

a plurality of generally parallel first end tanks, pairs of said first end tanks being joined together in a face-to-face relationship, the pairs of said first end tanks being joined together and aligned in a stack;

a plurality of generally parallel second end tanks, pairs of said second end tanks being joined together in a face-to-face relationship, the pairs of said second end tanks being joined together and aligned in a stack;

a plurality of extruded fluid carrying tubes, a pair of said tubes being spaced laterally and extending between and in fluid communication with a joined pair of said first end tanks and said second end tanks;

a plurality of fins attached to an exterior of said tubes; and each of the joined pair of said first end tanks and said second end tanks comprising stampings, each of the joined pair of said first end tanks having a pair of raised bosses spaced laterally and extending outwardly therefrom and each of said bosses including a flange extending axially to form an opening to receive an end of one of the pair of said tubes.

8. An evaporator as set forth in claim 7 wherein each of said bosses includes an aperture extending therethrough.

* * * * *